United States Patent [19]

Hopwood et al.

[11] Patent Number: 4,643,315

[45] Date of Patent: Feb. 17, 1987

[54] CARTON FOR FILM CASSETTES

[75] Inventors: Howard R. Hopwood, Wilmslow; Sylvia A. Lewis, Congleton; Peter C. Walker, Wilmslow, all of England

[73] Assignee: Ciba-Geigy AG, Basel, Switzerland

[21] Appl. No.: 866,190

[22] Filed: May 22, 1986

[30] Foreign Application Priority Data

May 24, 1985 [GB] United Kingdom ..... 8513153

[51] Int. Cl.[4] ..... B65D 5/54

[52] U.S. Cl. ..... 206/620; 206/628; 206/634; 229/41 R

[58] Field of Search ..... 206/611, 620, 628–631, 206/634; 229/41 R, 41 B

[56] References Cited

U.S. PATENT DOCUMENTS

| | | | |
|---|---|---|---|
| 1,961,375 | 6/1934 | McAleer | 206/620 |
| 2,007,520 | 7/1935 | Daller | 206/630 |
| 2,085,680 | 6/1937 | Grace, Jr. | 206/631 |
| 2,260,137 | 10/1941 | Donnelly | 206/629 |
| 2,275,134 | 3/1942 | Davidson | 206/631 |
| 2,708,545 | 5/1955 | Seith | 206/631 |
| 2,862,612 | 12/1958 | Brown | 206/620 |
| 3,084,844 | 4/1963 | Rattner | 229/115 |
| 3,454,212 | 7/1969 | Elward | 206/626 |

*Primary Examiner*—William Price
*Assistant Examiner*—Gary E. Elkins
*Attorney, Agent, or Firm*—Harry Falber

[57] ABSTRACT

There is described a carton which comprises first, second, third and fourth rectangular side walls hingedly connected in sequence along parallel edges, first and second pairs of opposed overlapping end walls connected to the edges of first and third walls whereby the side walls and the opposed end walls form an enclosure when the overlapping end walls are adhered together and the first and the fourth rectangular side walls are adherently connected by use of an extended end portion of either the first or fourth rectangular side walls, there being tear lines where each of the pair of end walls are connected to the edges of the first side wall, together with a tear line extending across the fourth side wall to both ends of the adjacent edge of the first side wall, whereby the first side wall can be disengaged from a portion of the fourth side wall and from the end walls so that the carton can be opened flat when all three tear lines are severed.

2 Claims, 4 Drawing Figures

CARTON FOR FILM CASSETTES

This invention relates to easy open cartons. Many cartons are formed from stamped out cardboard blanks with fold lines providing a series of wall panels which can be adhered together to provide, usually, a rectangular enclosure. Such cartons may be provided with tear lines which when severed enable the contents of the enclosure to be obtained easily without having to tear out one of the walls of the carton to do so.

Many such cartons contain products which are required to be used following written instructions. Also warranties and health warnings are often required to be included in the carton. To save the necessity to pack such documentation in the carton with the product it is becoming common to print such documentation on the inside of the carton and to construct the carton so that when the product is removed therefrom the carton can be opened flat.

Such a carton is described in U.S. Pat. No. 4,441,612. In this carton one tear line is required to be severed to enable a lid to be opened to obtain the contents of the carton. Then in order to lay flat the assembled carton two further tear lines are required to be severed and this requires a pull in a different direction to the pull required to sever the first tear line.

In another prior art patent specification U.S. Pat. No. 2,981,456 a sealed package is described but in order to lay flat this package no less than seven tear lines are required to be severed.

It is the object of the present invention to provide a carton which can be opened an also laid flat in one simple movement.

According to the present invention there is provided a carton which comprises first, second, third and fourth rectangular side walls hingedly connected in sequence along parallel edges, first and second pairs of opposed overlapping end walls connected to the edges of first and third side walls whereby said side walls and said opposed end walls form an enclosure when the said overlapping end walls are adhered together and said first and said fourth rectangular side walls are adherently connected by use of an extended end portion of either the first or fourth rectangular side walls, there being tear lines where each of the pair of said end walls are connected to the edges of said first side wall, together with a tear line extending across said fourth side wall to both ends of the adjacent edge of the said first side wall, whereby said first side wall can be disengaged from portion of said fourth side wall and from the end walls so that the carton can be opened flat when all three tear lines are severed.

In the carton of the present invention the tear line in the fourth side wall is severed to free a flap. When the free flap is lifted to open the carton the tear lines, which are along the edge of the carton where one pair of end walls are connected to the edge of the first side wall, are also severed and the carton can be laid flat in one simple lifting movement.

In the carton of the present invention preferably there are extensions to the edges of each of the second and fourth side walls but in the assemblied carton these extensions are tucked into the carton behind the adhered extensions which form the side walls. These extensions add to the rigidity of the carton when assemblied.

The accompanying drawings will serve to illustrate the invention.

In all the figures the same members represent the same parts.

Figure 1:
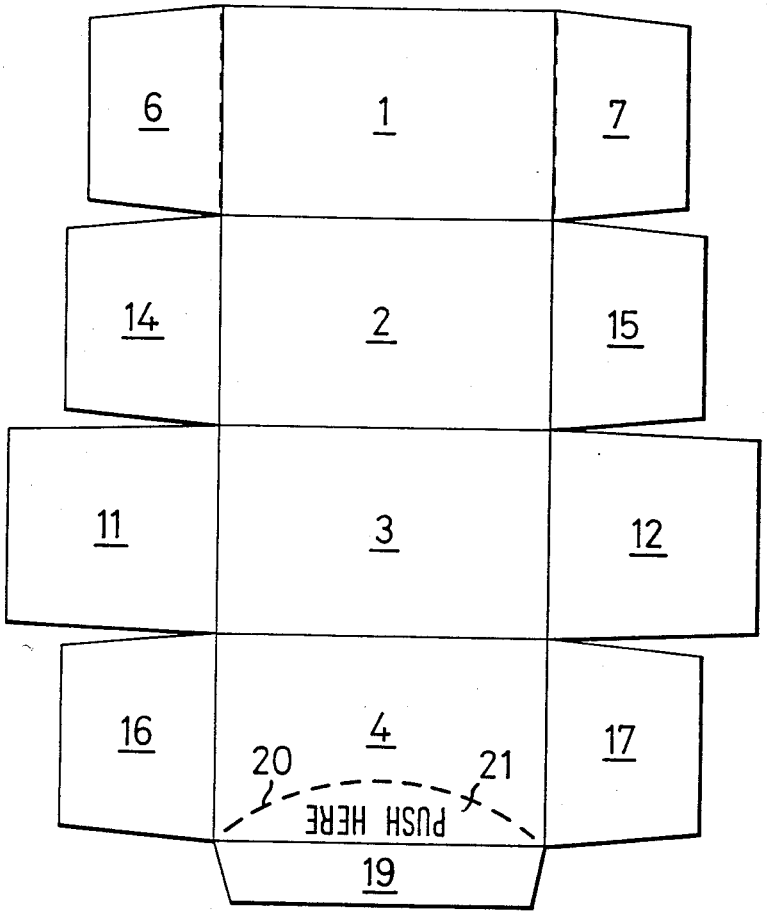
FIG. 1 is plan view of the outside of cardboard carton blank which can be used to make the carton of the present invention.

It is to be understood that the terms top, wall and bottom are purely relative to the orientation of the carton but for ease of identification the walls have been designated as the top side wall, the front side wall, the bottom side wall and the back side wall.

The carton comprises four side wall panels 1, 2, 3 and 4. For ease of reference panel 1 is referred to as the top side wall, panel 2 is referred to as the blank side wall, panel 3 is referred to as the bottom side wall and panel 4 is referred to as the front side wall.

Figure 4:
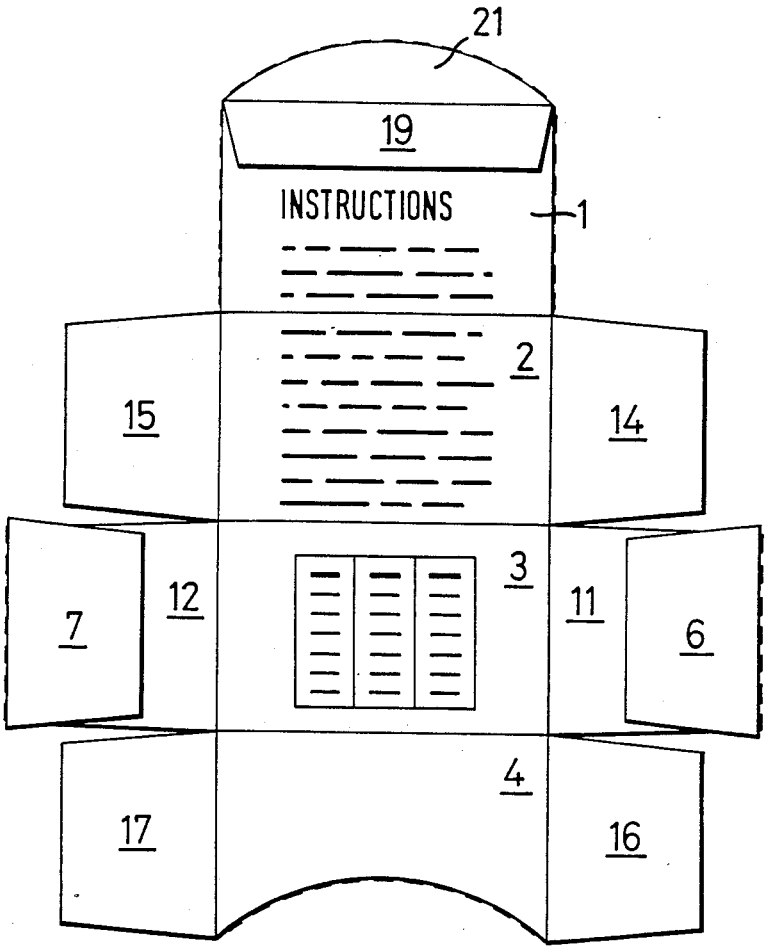
FIG. 4 is a plan view of the inside of the opened carton of FIGS. 2 and 3.

These four panels are hingedly connected as shown in FIGS. 1 and 4.

Panel 1 the top side wall or (lid 1) has panels 6 and 7 hingedly connected. A pair of tear lines 8 and 9 have been cut into the score lines which separate the panels 6 and 7 from panel 1. Panels 6 and 7 constitute one of the pair of overlapping end walls referred to above.

Panel 3 the bottom side wall has side panels 11 and 12 hingedly connected. Panels 11 and 12 constitute the second of the pair of overlapping end walls referred to above.

Figure 2:
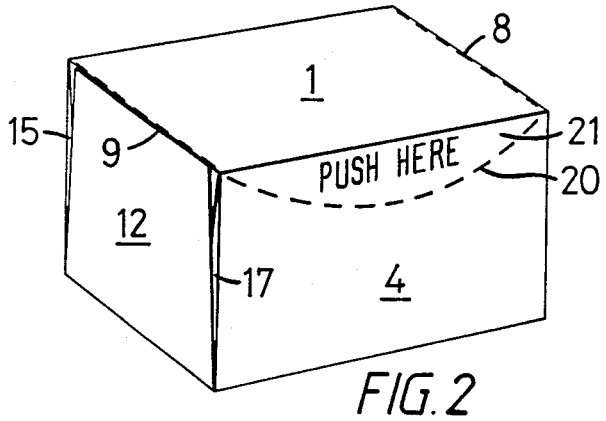
FIG. 2 is a perspective view of a carton set up from the blank shown in FIG. 1.
Figure 3:
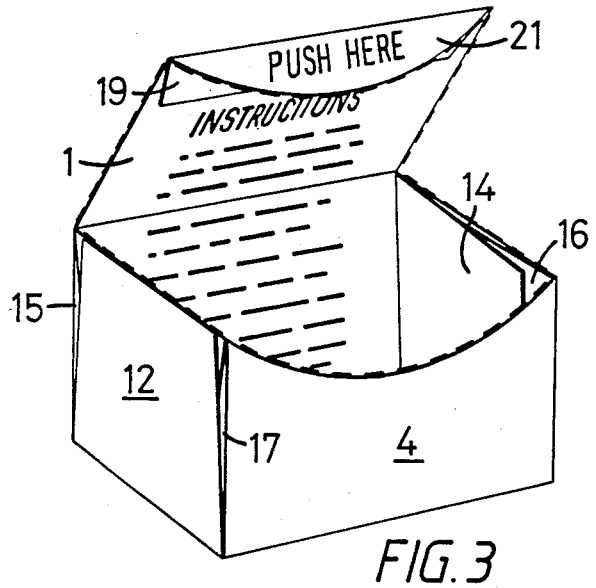
FIG. 3 is a perspective view of the carton of FIG. 2 with the lid opened.

As can be seen in FIG. 1, panels 11 and 12 are larger than panels 6 and 7 and the outside of panels 11 and 12 as shown in FIGS. 2 and 3 constitute the outside of the end walls of the assembled carton. In the assembled carton panel 11 is glued to panel 6 and panel 12 is glued to panel 7 to form the end walls of the carton.

Panel 2 the back side wall has side panels 14 and 15 hingedly connected thereto and panel 4 the front side wall has panels 16 and 17 hingedly connected thereto. These panels 14, 15, 16 and 17 are not adhered to any of the other panels or to themselves. They overlap in the assemblied carton and act to increase the rigidity of the structure.

Hingedly connected to panel 4 is an extension member 19. When the carton is assemblied extension member 19 is glued to the underside of the edge of panel 1.

Present on the face of panel 4 is a tear line 20 which delineates a curved portion 21 from the remainder of the panel 4. It is this portion that is pushed to open the assemblied carton.

The assemblied carton as shown in FIG. 2 is formed by folding up the blank of FIG. 1 to form a rectangular tube then gluing portion 19 to the underside of panel 1.

Side panels 14, 15, 16 and 17 are then bent over, panel 16 overlapping panel 14 and panel 17 overlapping panel 15. Panels 11 and 6 are then bent to overlap and are glued together so that panel 11 is on the outside of the carton. Panels 12 and 7 are then bent to overlap and are glued together so that panel 12 is on the outside of the carton.

A carton as shown in FIG. 2 is then obtained.

To open the carton portion 21 is pushed to sever the tear line 20. Portion 21 then becomes a free flap and when this is raised the tear lines 8 and 9 are then severed. This opens the lid of the carton which then opens flat out as panel 1 is no longer connected to panel 4 and the panels which constitute the end walls are no longer adhered together.

FIG. 3 shows the top panel 1 being raised before the whole carton is flattened out which is shown in FIG. 4.

FIG. 4 shows in particular the instructions and other documentation printed on the inside of the carton which is readily readable when the carton has been opened. It also shows panel 7 which has been severed from panel 1 glued to panel 12 and panel 6 which has also been severed from panel 1 glued to panel 11.

We claim:

1. A carton which comprises first, second, third and fourth rectangular side walls hingedly connected in sequence along parallel edges, first and second pairs of opposed overlapping end walls connected to edges of said first and third side walls whereby said side walls and said opposed end walls form an enclosure when the said overlapping end walls are adhered together and said first and said fourth rectangular side walls are adherently connected by use of an extended end portion of either the first or fourth rectangular side walls, there being tear lines where each of the first pair of said end walls are connected to the edges of said first side wall, together with a tear line extending across said fourth side wall to both ends of an adjacent edge of the said first side wall, whereby said first side wall can be disengaged from portion of said fourth side wall and from the end walls so that the carton can be opened flat when all three lines are severed.

2. A carton according to claim 1 which comprises extensions to edges of each of the second and fourth side walls which in the assembled carton are not adhered together.

* * * * *